US006024323A

United States Patent [19]

Palermo, Jr.

[11] Patent Number: 6,024,323

[45] Date of Patent: Feb. 15, 2000

[54] DISPENSER FOR ROLLED TISSUE AND THE LIKE

[76] Inventor: Anthony Palermo, Jr., 7399 Tattlersall Dr., Chesterland, Ohio 44026

[21] Appl. No.: 09/237,089

[22] Filed: Jan. 25, 1999

Related U.S. Application Data

[60] Provisional application No. 60/072,622, Jan. 26, 1998.

[51] Int. Cl.[7] ..... B65D 85/02

[52] U.S. Cl. ..... 242/588.6; 242/596.8; 242/599

[58] Field of Search ..... 242/588.6, 596.8, 242/588.3, 596.2, 599, 132, 137, 137.1, 138, 146

[56] References Cited

U.S. PATENT DOCUMENTS

| | | | |
|---|---|---|---|
| D. 348,579 | 7/1994 | Brandenburg . | |
| D. 351,749 | 10/1994 | Omdoll et al. . | |
| D. 373,276 | 9/1996 | Omdoll et al. . | |
| 1,267,017 | 5/1918 | Vickers | 242/137 X |
| 1,454,429 | 5/1923 | Dresser | 242/138 |
| 1,836,593 | 12/1931 | Harvey | 242/138 X |
| 3,009,618 | 11/1961 | Lerner | 242/588.3 X |
| 3,087,608 | 4/1963 | Craven | 242/588.6 |
| 3,283,886 | 11/1966 | Addis et al. | 242/588.6 |
| 3,472,364 | 10/1969 | Sloan | 242/588.3 X |
| 3,612,424 | 10/1971 | Friedel | 242/588.3 X |
| 3,843,071 | 10/1974 | Graham . | |
| 4,069,958 | 1/1978 | Strauss | 242/588.3 X |
| 4,089,481 | 5/1978 | Ciuci . | |
| 4,239,164 | 12/1980 | Barnsbee et al. | 242/596.8 X |
| 4,272,035 | 6/1981 | Sherman et al. | 242/596.8 X |
| 4,475,652 | 10/1984 | Heard | 242/588.3 X |
| 4,597,658 | 7/1986 | Buelens et al. . | |
| 4,659,028 | 4/1987 | Wren . | |
| 4,936,452 | 6/1990 | Pauley . | |
| 5,228,632 | 7/1993 | Addison et al. . | |
| 5,409,181 | 4/1995 | Patrick . | |
| 5,509,561 | 4/1996 | Kanterovitch . | |
| 5,562,262 | 10/1996 | Pennell | 242/588.3 |
| 5,692,700 | 12/1997 | Bobeczko | 242/588.6 X |
| 5,897,074 | 4/1999 | Marino | 242/596.8 X |

FOREIGN PATENT DOCUMENTS

| | | | |
|---|---|---|---|
| 3816183 | 11/1989 | Germany | 242/588.6 |

*Primary Examiner*—Donald P. Walsh
*Assistant Examiner*—Minh-Chau Pham
*Attorney, Agent, or Firm*—Timothy B. Gurin

[57] ABSTRACT

A tissue dispenser comprising a hollow container forms an inner chamber for housing a roll of tissue. The container comprises two separable housing components which when separated enable the insertion of rolled tissue into the chamber and when fitted together enclose and support the rolled tissue in the chamber. Each of the housing components are substantially identical. When fitted together, the housing components define the container walls and sides to surround the rolled tissue, an aperture through which the free end of the tissue is passed during dispensing and a spindle on which the rolled tissue is supported for dispensing. The tissue dispenser includes releasable mating means to releasably mate one housing component to the other to form the dispenser assembly.

12 Claims, 3 Drawing Sheets

DISPENSER FOR ROLLED TISSUE AND THE LIKE

CROSS REFERENCE TO RELATED APPLICATION

This application claims the benefit of Provisional Application Ser. No. 60/072,622 filed Jan. 26, 1998 in the name of Anthony Palermo, Jr. for Tissue Dispenser.

INTRODUCTION

The present invention relates to improved and cost effective dispensers for rolled toilet tissue and the like.

BACKGROUND OF THE INVENTION

Tissue is typically available in two forms: facial tissue available in stacked, and commonly interleaved, form packaged in a disposable box with an outlet in the upper surface of the box; and toilet tissue available in a continuous strip of perforated sheets in rolled form. On an individual sheet basis, facial tissue is more expensive than toilet tissue, in part because of the disposable box in which the tissue is packaged.

Dispensers for rolled tissue have been suggested in the past. Commonly, dispensers for rolled tissue are adapted to be securely mounted to the wall of a bathroom. It has also been shown to provide a portable dispenser for rolled tissue as an alternative to the facial tissue box described above.

Wren U.S. Pat. No. 4,659,028 discloses a portable dispenser for rolled toilet tissue. The Wren dispenser includes a base adapted to receive a roll in rotatable condition and an outlet structure comprising a tissue constricting ring through which the tissue is fed. A bill-like projection extends out from the bottom of the outlet to assist in breaking the tissue from one another along a perforation line. A box-like cover fits over the entire assembly to improve aesthetics.

Pauley U.S. Pat. No. 4,936,452 discloses a bathroom tissue container wherein an elongate tubular support member includes an elongate slot therein with a threaded cap securably mounted to the support member overlying the slot. In a further embodiment, the Pauley patent discloses a first cylindrical container which slidingly receives thereover a second cylindrical container. The first container includes a first container support rod of a length substantially equal to the axial length of the first container and the second container. An upper terminal end of the first container support rod is receivable within a second hollow support rod axially aligned with and secured to the second cylindrical container to maintain a roll of tissue therein.

Because of their multiple parts of varying configurations, the tissue dispensers previously described tend to be expensive to manufacture and cumbersome to use. The invention of the present application overcomes these problems and others.

SUMMARY OF THE INVENTION

It is therefore an object of this invention to provide a low cost dispenser for rolled tissue and the like that is easy to use and aesthetically pleasing.

In accordance with the present invention, a tissue dispenser is provided. The dispenser comprises a hollow container forming an inner chamber for housing a roll of tissue. The container includes two separable housing components which when separated enable the insertion of rolled tissue into the chamber and when fitted together enclose and support the rolled tissue in the chamber. Each of the housing components are substantially identical and thus can be molded from a single mold. When fitted together, the housing components define the container walls and sides to surround the rolled tissue, an aperture through which the free end of the tissue is passed during dispensing and a spindle on which the rolled tissue is supported for dispensing.

In accordance with another aspect of the present invention, the dispenser includes releasable mating means which releasably secures the housing components together in opposing relationship to form the hollow container. The housing components can be easily separated to gain access to the inside of the container to replace the tissue roll and reassembled without the use of any tools.

In accordance with yet another aspect of the present invention, the releasable mating means comprises a clip portion formed along the periphery of a side portion of one housing component and a latch portion formed along the periphery of a side portion of the other housing component. In an alternate configuration of the releasable mating means, a tongue portion, formed along a periphery of a side portion of one housing component interferingly fits with the opposing side portion of the other housing component. The interference fit between the two components acts to hold the components together. In yet a third configuration of the releasable mating means, magnets of opposite polarity are fastened to the opposing ends of the spindle portions. When the two housing components are mated together, the magnetic force between the two magnets acts to hold the components together.

An advantage of the present invention is the low tooling cost to manufacture the components to form the dispenser. Because the two housing components that form the dispenser are substantially identical, they can be molded from a single mold.

A further advantage of the present invention is to provide an aesthetically pleasing dispenser of lower cost rolled toilet tissue that is portable and can be used in a variety of locations such as a bedroom, office or a motor vehicle.

Still further advantages of the present invention will become apparent to those of ordinary skill in the art upon reading and understanding the following detailed description.

DETAILED DESCRIPTION OF THE PREFERRED EMBODIMENT

Figure 1:
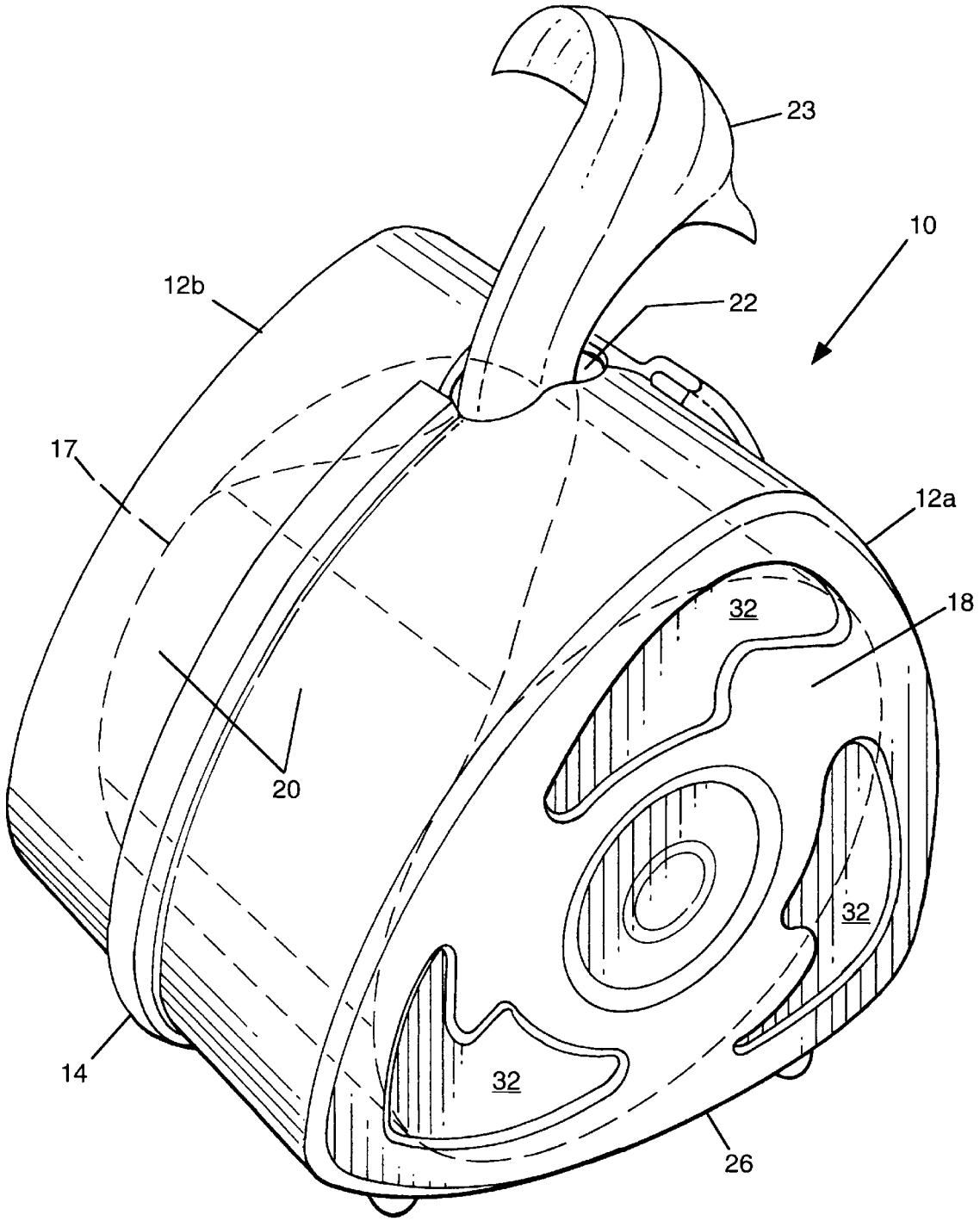
FIG. 1 is a perspective view of the tissue dispenser of the present invention.

With reference now to the drawings, and in particular reference to FIG. 1, a new and improved tissue dispenser is described. The tissue dispenser apparatus of the present invention is generally designated by numeral 10. The dispenser 10 is a hollow container comprised of two substantially identical housing components 12a and 12b which, when fitted together, form a housing assembly 14 and an inner chamber 16 within which a roll of tissue 17, shown in phantom, can be supported for dispensing. The housing assembly defines the container walls 18 and sides 20 to surround the rolled tissue, an aperture 22 through which the free end of the tissue 23 is passed during dispensing, a spindle 24 (FIGS. 2 and 3) on which the tissue is supported for dispensing, and a base 26 positioned generally opposite the aperture.

The housing components 12*a* and 12*b* are preferably made of injection molded polystyrene and can be of any desired color. Other materials, such as polyethylene or polypropolene can also be used. Each of the housing components are substantially identical, and thus can be molded from a single mold. Because only a single mold is used and since only two substantially identical parts are required for the assembly, the cost to manufacture and assemble the tissue dispenser of the present invention is reduced over prior designs. Moreover, the unique manner in which the molded components are formed to fit together lend to easy use especially when replacement of a tissue roll is required. These advantages will be more fully described below.

Figure 2:
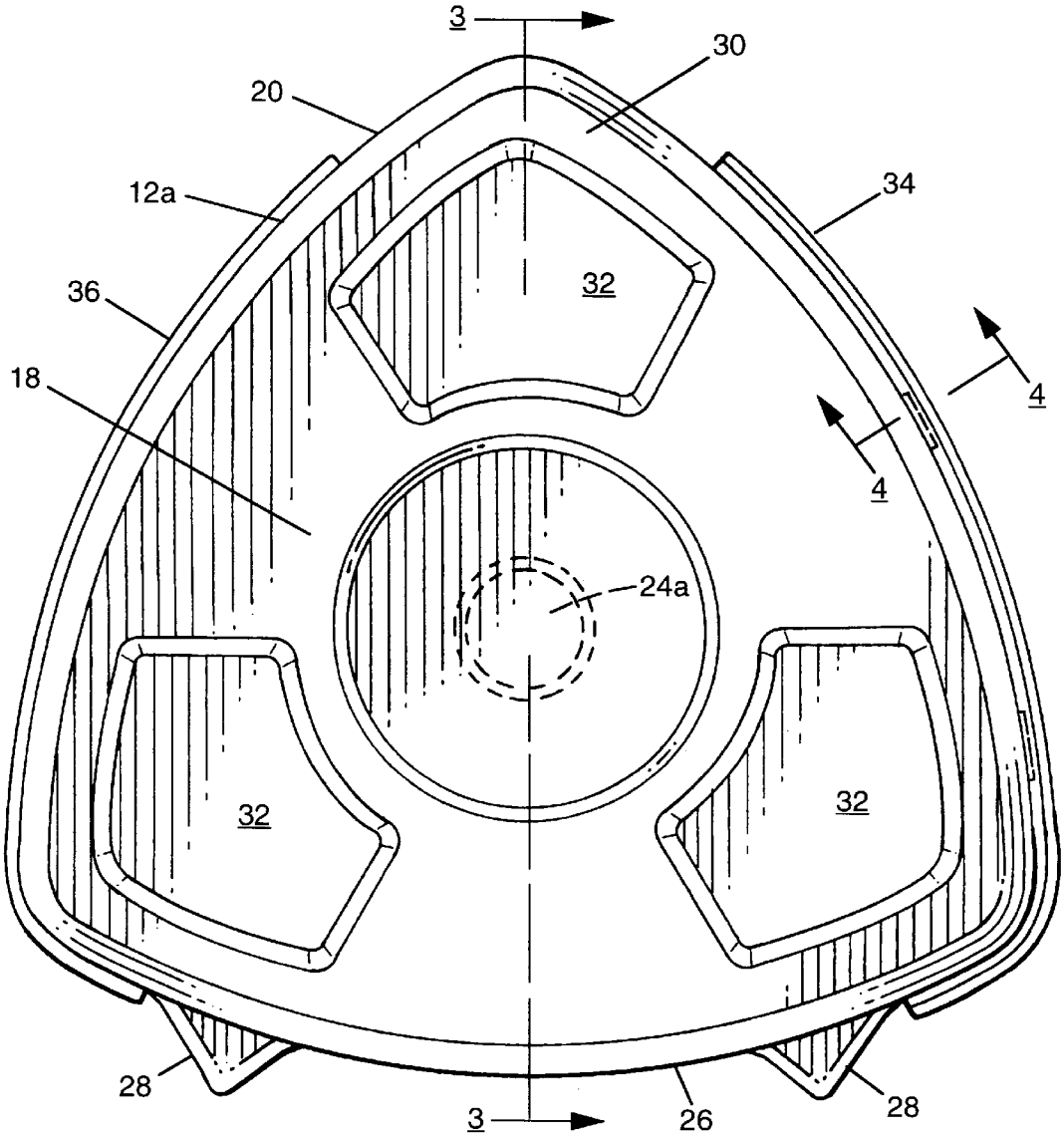
FIG. 2 is a front view of one of the housing components of the present invention.
Figure 3:
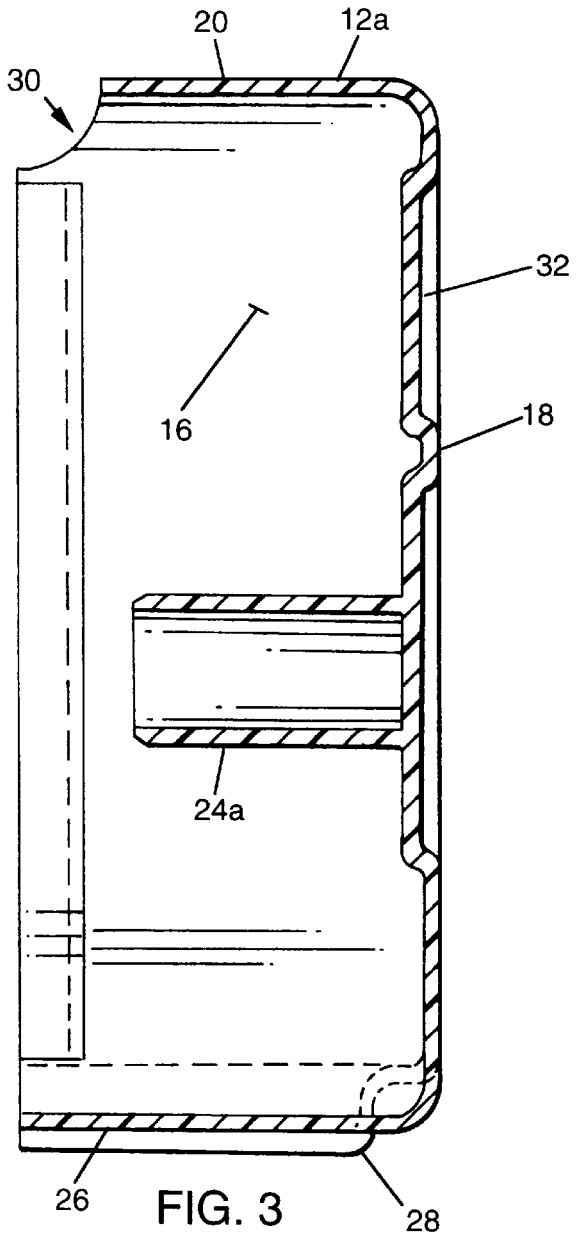
FIG. 3 is a side view of one of the housing components of the present invention.

Referring now to FIGS. 2 and 3, one of the housing components 12*a* and 12*b* is described in more detail. As the housing components 12*a* and 12*b* are substantially identical, only one component will be described. The following description, however, applies equally to both components. Each of the housing components comprise a one half portion of the dispenser and define a rigid wall structure and side portions. The housing components can be of any convenient shape although the rounded triangular shape presents a good balance of aesthetics and stability. One side of the housing comprises a base portion 26. Molded into the housing component at the base side are base feet 28 to provide a stable platform for when the dispenser is placed on a flat surface for use. At the apex of the triangle opposite the base side, each housing component has a semi-circular or semi-ellipsoid cutout 30 which defines a portion of the aperture 22. Internal the housing component at a point equidistant from the side portion is molded a spindle portion 24*a* defining the center hub of the housing component. The spindle portion extends outwardly from the wall 18 a distance slightly less than the width of the side portions. Three indent portions 32 are molded into the wall 18 symmetrically around the center hub of the housing component. These indent portions can be of any desired shape (note the different shapes shown in FIGS. 1 and 2) and provide structural rigidity to the side walls and also provide an aesthetically pleasing design. In each of the indent portions on the exterior of the housing, one can place decals adding to the design of the dispenser.

Figure 4:
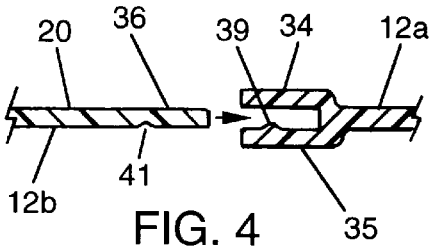
FIG. 4 is a cross-sectional view of a portion of the tissue dispenser of the present invention detailing an embodiment of the releasable mating means.

Along the peripheral edge of the housing components, means are provided to releasably mate the two components in opposing relationship to form the assembled dispenser. Referring to FIGS. 2 and 4, for illustration, the releasable mating means of the preferred embodiment is shown in more detail. The peripheral edge on the right side of the component 12*a*, 12*b* comprises a tongue portion 34 which runs along the right side from about the right edge of the aperture portion 30 down to about the edge of right foot portion 28. The peripheral edge on the left side of the component 12*a*, 12*b* comprises the left edge of the left side 20. When two housing components are aligned in opposing relationship, the tongue portion 34 of one component fits over the edge of side 20 of the opposite component, and vice versa. In this embodiment, the dimension from the center hub of the housing component to the internal surface of the tongue portion 34 is sized to create a clearance fit with the opposite side of the mating component. In order to hold the two components together in use, a clip and latch arrangement is provided. About midway along the peripheral edge of the right side of a component 12*a*, 12*b*, a clip portion 35 (shown in FIG. 4) is provided. The clip portion 35 preferably extends along the peripheral edge about one inch and, together with the tongue portion, form a "c" shaped recess. The clip portion also includes a raised detent 39. In a corresponding location along the peripheral edge of the left side of a component 12*a*, 12*b*, a latch portion 36 is provided. The latch portion includes an indent portion 41. When two housing components are aligned in opposing relationship, the latch portion 36 of one component aligns with the "c" shaped recess and the clip portion 35 of the opposing component, and vice versa. The "c" shaped recess receives the latch portion allowing the detent of the clip portion to mate with the indent of the opposite latch portion. The two components are pressed together to snap one component to the other to form the dispenser assembly.

Figure 5:
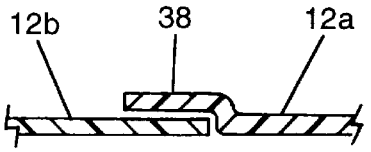
FIG. 5 is a cross-sectional view of a portion of the tissue dispenser of the present invention detailing an embodiment of the releasable mating means.

In an alternate embodiment shown in FIG. 5, the releasable mating means is formed by an interference fit between a tongue portion 38 extending along a peripheral edge of one side of each of the housing components and the opposite side of the mating component. As with the clip and latch arrangement described above, the tongue portion 38 extends along the periphery of one side of each of the housing components from about the edge of the aperture potion 30 down to about the outer edge of a foot portion 28. The dimension from the center hub of the housing component to the internal surface of the tongue portion is sized to create a slight interference fit with the opposite side portion of the mating component when the components are fitted together. Thus, when two housing components are aligned in opposing relationship, the tongue portion of one component fits snugly with the side portion of the opposite component, and vice versa. The interference fit between the two components acts to hold the components together.

Figure 6:
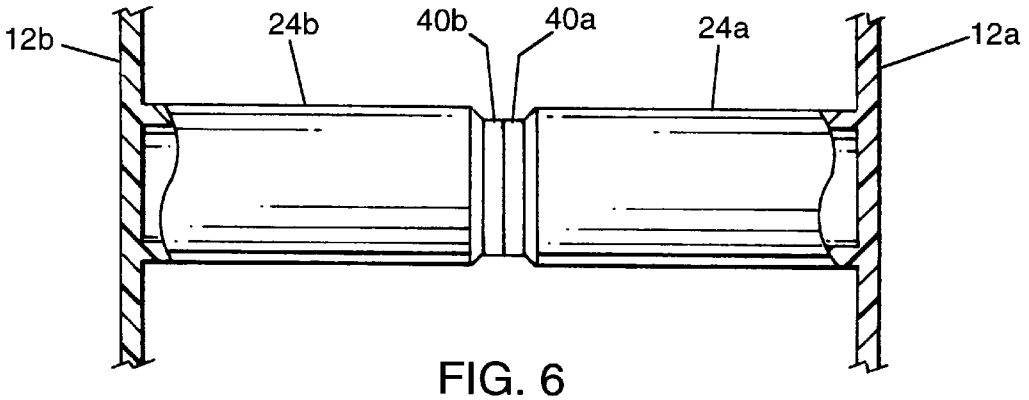
FIG. 6 is a cross-sectional view of a portion of the tissue dispenser of the present invention detailing an embodiment of the releasable mating means.

In yet another embodiment shown in FIG. 6, the releasable mating means comprises two magnets of opposite polarity 40*a* and 40*b* glued or otherwise fastened to the opposing ends of the spindle portions 24*a*, 24*b*. When the two housing components are mated together, the magnetic force between the two magnets acts to hold the components together.

Other releasable mating means are contemplated such as Velcro™ fasteners.

In use, a roll of toilet tissue is placed on the spindle of one of the housing components through the tubular former of the tissue roll. The free end of the tissue is routed through the aperture portion 30. The second housing component is placed in opposing relation to the first assuring that the spindle portion of the second component fits into the tubular former of the roll. The components are mated using the releasable mating means. The free end of the tissue is available for use through the aperture formed by the two mated components.

The invention has been described with reference to the preferred embodiments. Obviously, modifications and alterations may occur to others upon reading and understanding the preceding detailed description. It is intended that the invention be construed as including all such modifications and alterations insofar as they come within the scope of the appended claims or their equivalents.

Having thus described the preferred embodiment, I claim:

1. A tissue dispenser comprising:

two substantially identical housing components, each of said components defining an aperture portion and including a spindle portion, a base portion, and a releasable mating means, said housing components releasably matable to each other in opposing relationship.

2. The tissue dispenser of claim 1 wherein the releasable mating means further comprises a clip portion formed along the periphery of a side portion of one housing component and a latch portion formed along the periphery of a side portion of the other housing component.

3. The tissue dispenser of claim 1 wherein the releasable mating means further comprises a tongue portion formed along a periphery of a side portion.

4. The tissue dispenser of claim 3 wherein the tongue portion of one housing component interferingly fits with the opposing side portion of the other housing component.

5. The tissue dispenser of claim 1 wherein the releasable mating means further comprises magnets of opposite polarity fastened to the opposing ends of the spindle portions.

6. A tissue dispenser comprising a hollow container forming an inner chamber for housing a roll of tissue, said container comprising two substantially identical separable housing components which when separated enable the insertion of rolled tissue into the chamber and when fitted together enclose and support the rolled tissue in the chamber, and which define the container walls and sides to surround the rolled tissue, an aperture through which the free end of the tissue is passed during dispensing, and a spindle on which the rolled tissue is supported for dispensing.

7. The tissue dispenser of claim 6 wherein the housing components further define a base generally opposite the aperture.

8. The tissue dispenser of claim 6 further comprising releasable mating means.

9. The tissue dispenser of claim 8 wherein the releasable mating means further comprises a clip portion formed along the periphery of a side portion of one housing component and a latch portion formed along the periphery of a side portion of the other housing component.

10. The tissue dispenser of claim 8 wherein the releasable mating means further comprises a tongue portion formed along a periphery of a side portion.

11. The tissue dispenser of claim 10 wherein the tongue portion of one housing component interferingly fits with the opposing side portion of the other housing component.

12. The tissue dispenser of claim 8 wherein the releasable mating means further comprises magnets of opposite polarity fastened to the opposing ends of the spindle portions.

* * * * *